US006682616B1

(12) United States Patent
Yamato et al.

(10) Patent No.: US 6,682,616 B1
(45) Date of Patent: Jan. 27, 2004

(54) GAS GENERATING COMPOSITION FOR USE IN A PRETENSIONER

(75) Inventors: Yo Yamato, Hyogo (JP); Hideya Osawa, Hyogo (JP)

(73) Assignee: Daicel Chemical Industries, Ltd., Osaka (JP)

( * ) Notice: Subject to any disclaimer, the term of this patent is extended or adjusted under 35 U.S.C. 154(b) by 95 days.

(21) Appl. No.: 09/959,621

(22) PCT Filed: Jun. 16, 2000

(86) PCT No.: PCT/JP00/03961

§ 371 (c)(1),
(2), (4) Date: Nov. 1, 2001

(87) PCT Pub. No.: WO00/78696

PCT Pub. Date: Dec. 28, 2000

(30) Foreign Application Priority Data

Jun. 17, 1999 (JP) ..... 11-170610

(51) Int. Cl.[7] ..... C06B 31/00; C06B 45/10
(52) U.S. Cl. ..... 149/45; 149/19.1
(58) Field of Search ..... 149/19.1, 19.7, 149/76, 45

(56) References Cited

U.S. PATENT DOCUMENTS 5,503,079 A 4/1996 Kishi et al.
5,610,444 A * 3/1997 Austrey et al. ..... 264/3.3
5,635,665 A 6/1997 Kishi et al.
6,093,269 A * 7/2000 Lundstrom et al. ..... 149/36
6,368,432 B2 * 4/2002 Serizawa et al. ..... 149/46

FOREIGN PATENT DOCUMENTS

| | | |
|---|---|---|
| JP | A 49-50619 | 5/1974 |
| JP | A 2-293389 | 12/1990 |
| JP | A 10-130086 | 5/1998 |
| JP | A 11-92264 | 4/1999 |
| JP | A 2000-119088 | 4/2000 |
| WO | WO 93/16019 | 8/1993 |
| WO | WO 96/25375 | 8/1996 |
| WO | WO98/42642 | 1/1998 |

* cited by examiner

*Primary Examiner*—Michael J. Carone
*Assistant Examiner*—Aileen B. Felton
(74) *Attorney, Agent, or Firm*—Birch, Stewart, Kolasch & Birch, LLP

(57) ABSTRACT

A gas generating composition for use in a pretensioner, which generates less CO gases and chlorine-containing gases after combustion and is superior in thermal stability and in producing and processing, is obtained. The gas generating composition for use in a pretensioner comprises a highly thermal stabilized binder, an oxidizing agent, and, if required, a chlorine-neutralizing agent as major ingredients. The gas generating composition can improve thermal stability of a gas generating agent, can reduce the amount of CO gases, is excellent in producing and processing, and can reduce chlorine-containing gases if required.

18 Claims, No Drawings

GAS GENERATING COMPOSITION FOR USE IN A PRETENSIONER

This application is the national phase under 35 U.S.C. §371 of PCT International Application No. PCT/JP00/03961 which has an International filing date of Jun. 16, 2000, which designated the United States of America and was not published in English.

TECHNICAL FIELD WHERE THE INVENTION BELONGS

The present invention relates to a gas generating agent for generating an operation gas in pretensioner systems that are mounted on, for example, automobiles and aircrafts in order to protect human bodies.

BACKGROUND OF THE INVENTION

Heretofore, a seat belt is disposed on vehicles such as automobiles for protecting drivers against impact shocks upon collision. To further increase safety improvement, a pretensioner system, which comprises "a pretensioner", i.e. an emergency pull-in device disposed to a seat belt roll-up device for retracting the seat belt, has been prevailing recently. And by the pretensioner, the seat belt is retracted instantly to hold passenger's body.

In such a pretensioner, since the seat belt has to be retracted instantaneously, a gas generated upon combustion of a gunpowder is utilized as a power source. That is, a piston inside a cylinder is instantaneously moved by the combustion gas from a gas generating agent, and a power is supplied to the pretensioner by the movement of a cable connected at one end to the piston.

As the gas generating agent used for the pretensioner, for example, JP-A 49-50619 discloses that a single base propellant, a double base propellant, and a triple base propellant, using nitrocellulose as a base agent, can be used.

Such well-known conventional propellants have high combustibility but have a problem that gases after combustion contain a great amount of noxious CO gases. And with an increasing consciousness for safety, pretensioners have tended to be used not only for a driver seat but also for a passenger seat and rear seats, so that an amount of CO gases is no longer negligible.

Further, because these well-known existing propellants are based on nitric ester such as nitrocellulose and nitroglycerin, there is the problem of poor thermal stability. These are not preferable in the pretensioner desired to exhibit stable performance for a prolonged period of time.

At present, however, a method of improving gases after combustion of the single base propellant, the double base propellant, and the triple base propellant, using nitrocellulose as the base agent, and a method of improving thermal stability of such propellants, have not been specifically provided.

Further, JP-A 2-293389 discloses, for example, a gas generating agent comprising cellulose acetate and ammonium perchlorate. Certainly, this makes possible to improve thermal stability and reduce an amount of CO gases. However, when cellulose acetate is used as a binder, procedures such as extrusion molding and cutting operation are very difficult and producing and processing are also difficult. In addition, when ammonium perchlorate is used as an oxidizing agent, generation of chlorine-containing gases such as hydrogen chloride in gases after combustion may be a problem.

DISCLOSURE OF THE INVENTION

In view of the above, it is an object of the present invention to provide a gas generating composition superior in thermal stability, capable of decreasing an amount of CO gases, excellent in producing and processing, and capable of reducing chlorine-containing gases if required, by combination of a highly thermal stabilized binder and an oxidizing agent as major components.

Another object of the present invention is to provide a pretensioner system using the gas generating composition described above.

The present inventors found that by combining a highly thermal stabilized binder with an oxidizing agent as major components, it is possible to provide a gas generating composition superior in thermal stability, capable of decreasing an amount of CO gases, excellent in producing and processing, and capable of reducing chlorine-containing gases if required, thus arriving at the completion of the present invention.

That is, the present invention provides a gas generating composition for use in a pretensioner, which is superior in thermal stability, capable of reducing CO gases and excellent in producing and processing. In addition, the present invention provides a gas generating composition which is superior in thermal stability, capable of reducing CO gases and capable of reducing chlorine-containing gases.

The gas generating composition of the present invention can be applied to a seat belt device for a vehicle passenger, comprising a belt, a roll-up device for rolling up the belt, a pretensioner for retracting the belt at an emergency, a gas generating agent and a power transmitting unit for driving the pretensioner.

Further, it can also be applied to a method of restraining a passenger's body comprising the steps of actuating the pretensioner at an emergency by using a gas generating agent, and retracting the belt in a seal belt system for a vehicle passenger comprising a belt, a roll-up device for rolling up the belt, a pretensioner for retracting the belt at an emergency, a gas generating agent and a means for transmitting power by a generated gas thereby driving the pretensioner.

The gas generating composition for use in a pretensioner according to the present invention is capable of improving the thermal stability of a gas generating agent, capable of decreasing an amount of CO gases, excellent in producing and processing, and capable of reducing chlorine-containing gases if required, by combination of a highly thermal stabilized binder and an oxidizing agent as major components. Accordingly, the safety of a vehicle passenger can be improved and a highly reliable pretensioner system can be obtained.

PREFERRED EMBODIMENT OF THE INVENTION

The gas generating composition used in one embodiment of the present invention comprises a binder and an oxidizing agent.

The binder, can include at least one compound selected from the group consisting of cellulose acetate butyrate (CAB) carboxymethyl cellulose sodium (CMC-Na), hydroxyethyl cellulose (HEC), hydroxypropyl cellulose (HPC), methyl cellulose (MC), ethyl hydroxyethyl cellulose (EHEC), carboxymethyl ethyl cellulose (CMEC), starch, guar gum, polyvinyl alcohol (PVA), polyacrylamide, silicone, acrylic ruber, polystyrene (PS), polyacrylonitrile (PAN), polyvinyl chloride (PVC), hydroxy-terminated polybutadiene (HTPB), carboxy-terminated polybutadiene (CTPB) and glycidyl azide polymer (GAP). Because these compounds are superior in thermal stability and producing and processing (handling easiness in manufacturing) to known nitrocellulose and cellulose acetate (CA), the thermal stability of the gas generating composition and producing and processing the gas generating composition are also improved.

The binders described above may be used singly or in combination thereof. By use of a plurality of binders, handling easiness during manufacturing, such as the viscosity of the gas generating composition and the hardness, flexibility etc. of the molded article can be improved. For example, the molded article is easily broken or disrupted when cellulose acetate is used alone, but the handling qualities thereof can be improved by mixing it with cellulose acetate butyrate.

The content of the binder in the gas generating composition is varied depending on the type and amount of the nitrogen-containing compound, oxidizing agent, chlorine-neutralizing agent, ignition improver, stabilizer, flash reducing agent, plasticizer, deterrent, glazing, curing agent, bonding agent, crosslinking agent, metal fuel, combustion catalyst and aging inhibitor as well as oxygen balance, but the content of the binder is preferably 7 to 30% by weight, particularly preferably 8 to 25% by weight.

Further, the gas generating composition of the present invention can be blended with an oxidizing agent.

The oxidizing agent is preferably one or more compounds selected from the group consisting of ammonium salts, alkali metal salts and alkaline earth metal salts of chloric acid, perchloric acid, nitric acid and nitrous acid, more preferably one or more members selected from the group consisting of ammonium perchlorate, potassium perchlorate, sodium perchlorate, potassium nitrate, sodium nitrate and strontium nitrate. These oxidizing agents may be used two or more in combination thereof.

These oxidizing agents are used in order to burn the binder. To reduce the generation of CO due to incomplete combustion of the binder, the amount of the oxidizing agent is preferably controlled such that the oxygen balance approaches 0. The content of the oxidizing agent in the gas generating composition is preferably 70 to 93% by weight, particularly preferably 75 to 92% by weight.

Another embodiment of the gas generating composition of the present invention consists of a binder, an oxidizing agent and a chlorine-neutralizing agent.

The binder used in this composition can include at least one compound selected from the group consisting of cellulose acetate (CA), cellulose acetate butyrate (CAB), carboxymethyl cellulose sodium (CMC-Na), hydroxyethyl cellulose (HEC), hydroxypropyl cellulose (HPC), methyl cellulose (MC), ethyl cellulose (EC), ethyl hydroxyethyl cellulose (EHEC), carboxymethyl ethyl cellulose (CMEC), starch, guar gum, polyvinyl alcohol (PVA), polyacrylamide, silicone, acrylic ruber, polystyrene (PS), polybutadiene (PB), polyacrylonitrile (PAN), polyvinyl chloride (PVC), polyurethane, hydroxy-terminated polybutadiene (HTPB), carboxy-terminated polybutadiene (CTPB) and glycidyl azide polymer (GAP).

The binders described above may be used singly or in combination thereof. By use of a plurality of binders, handling easiness during manufacturing, such as the viscosity of the gas generating composition and the hardness, flexibility etc. of the molded article can be improved. For example, the molded article is easily broken or disrupted when cellulose acetate is used alone, but the handling easiness thereof can be improved by mixing it with cellulose acetate butyrate.

The content of the binder in the gas generating composition is varied depending on the type and amount of the nitrogen-containing compound, oxidizing agent, chlorine-neutralizing agent, ignition improver, stabilizer, flash reducing agent, plasticizer, deterrent, glazing, curing agent, bonding agent, crosslinking agent, metal fuel, combustion catalyst and aging inhibitor as well as oxygen balance, but the content of the binder is preferably 7 to 30% by weight, particularly preferably 8 to 25% by weight.

Further, the gas generating composition of the present invention can be blended with an oxidizing agent. The oxidizing agent is preferably one or more compounds selected from the group consisting of ammonium salts, alkali metal salts and alkaline earth metal salts of chloric acid, perchloric acid, nitric acid and nitrous acid, more preferably one or more members selected from ammonium perchlorate, potassium perchlorate, sodium perchlorate, potassium nitrate, sodium nitrate and strontium nitrate. These oxidizing agents may be used two or more in combination thereof.

These oxidizing agents are used in order to burn the binder. To reduce CO generated due to incomplete combustion of the binder, the amount of the oxidizing agent is preferably controlled so that the oxygen balance approaches 0. The content of the oxidizing agent in the gas generating composition is preferably 70 to 93% by weight, particularly preferably 75 to 92% by weight.

Further, the gas generating composition of the present invention can contain a chlorine-neutralizing agent.

It is important to use the chlorine-neutralizing agent in order to reduce chlorine-containing gases, for example, a case that ammonium perchlorate is used as the oxidizing agent. This chlorine-neutralizing agent can include one or more members selected from compounds containing cations selected from alkali metals and alkaline earth metals. These chlorine-neutralizing agents may be used in admixture of two or more agents.

Such chlorine-neutralizing agents can include, for example, sodium carbonate, sodium silicate, sodium nitrate, sodium oxalate, potassium carbonate, potassium silicate, potassium nitrate, potassium oxalate, magnesium carbonate, magnesium silicate, magnesium nitrate, magnesium oxalate, strontium carbonate, strontium silicate, strontium nitrate, strontium oxalate, calcium carbonate, calcium silicate, calcium nitrate, calcium oxalate, magnesium oxide, strontium oxide, calcium oxide, magnesium peroxide, strontium peroxide, calcium peroxide, and sodium salts of carboxyl methyl cellulose. The content of the chlorine-neutralizing agent in the gas generating composition is preferably 5 to 50% by weight.

The function of the chlorine-neutralizing agent is to neutralize and stabilize chlorine-containing gases such as hydrogen chloride and chlorine gas generated upon combustion of a compound containing chlorine atoms by alkali metals or alkaline earth metals. The stabilized neutral salt includes sodium chloride, potassium chloride, magnesium chloride, strontium chloride, calcium chloride etc., and these are such low toxic materials that they can be regarded as almost nontoxic. The chlorine-containing gases are not preferable and should be reduced to the allowable limit. This allowable amount of the chlorine-containing gases depends on conditions such as output of the pretensioner, the number of pretensioners used in a vehicle and the volume of a vehicle etc. That is, the chlorine-containing gases are required within the limit causing no problem when the pretensioner has been developed in a closed vehicle.

The gas generating composition of the present invention in any form can further contain a nitrogen-containing compound. The nitrogen-containing compound can be the one selected from the group consisting of guanidine derivative, tetrazole derivative, bitetrazole derivative, triazole derivative, hydrazine derivative, triazine derivative, azodicarbonamide derivative, dicyanamide derivative and nitramine derivative. These nitrogen-containing compounds may be used in admixture of two or more compounds.

Such nitrogen-containing compounds can include, for example, nitroguanidine, guanidinenitrate, 5-aminotetrazole, bitetrazole diammonium salt, trihydrazinotriazine, dinitroammeline, dicyandiamide, azodicarbonamide, hydrazodicarbonamide, trimethylene trinitramine (RDX), tetramethylene tetranitramine (HMX), and ethylene dinitramine (EDNA).

Because the binder used in the present invention contains a large number of carbon atoms in the molecule, a large amount of the oxidizing agent is required. Accordingly, the nitrogen-containing compound which is a compound having a very small amount of carbon atoms but containing a large amount of nitrogen atoms and hydrogen atoms can be added to the gas generating composition to lower the amount of the oxidizing agent and to raise the gas output. The content of the nitrogen-containing compound in the gas generating composition is preferably 5 to 50% by weight, particularly preferably 6 to 40% by weight.

Further, the gas generating composition of the present invention can be blended with an ignition improver. This ignition improver can include nitrocellulose (NC), cellulose acetate nitrate (CAN) and cellulose nitrate carboxymethyl ether (CNC) as well as a mixture thereof. The content of the ignition improver in the gas generating composition is preferably 1 to 10% by weight, particularly preferably 2 to 8% by weight.

Further, the gas generating composition of the present invention can be blended with a stabilizer. This stabilizer can include diphenyl amine, 2-nitrodiphenyl amine, ethyl centralit and resorcinol as well as a mixture thereof. The content of the stabilizer in the gas generating composition is preferably 0.1 to 2% by weight, particularly preferably 0.8 to 1.2% by weight.

Further, the gas generating composition of the present invention can be blended with a flash reducing agent. The flash reducing agent can include, for example, potassium sulfate, barium nitrate and cryolite as well as a mixture thereof. The content of the flash reducing agent in the gas generating composition is preferably 0.1 to 5% by weight, particularly preferably 1 to 2% by weight.

Further, the gas generating composition of the present invention can be blended with a plasticizer. The plasticizer can include, for example, dioctyl phthalate, diethylene glycol dinitrate, dibutyl phthalate, triacetin, acetyl triethyl citrate, dioctyl adipate, butyl phthalyl butyl glycolate, methyl phthalyl ethyl glycolate (MPEG) and ethyl phthalyl ethyl glycolate (EPEG) as well as a mixture thereof. The content of the plasticizer in the gas generating composition is preferably 0.1 to 10% by weight, particularly preferably 3 to 5% by weight.

The surface of the gas generating composition of the present invention can be coated with a combustion suppressing material when moderate combustion is required at the initial stage of the combustion. The deterrent can include, for example, dinitrotoluene, dibutyl phthalate, camphor and ethyl centralit as well as a mixture thereof. The content of the deterrent in the gas generating composition is preferably 0.1 to 10% by weight, particularly preferably 2 to 6% by weight.

Further, the gas generating composition of the present invention can be provided with gloss by a glazing when it tends to be statically charged after drying. The gloss treatment prevents static charge, and also has an effect of improving smoothness upon charging of the gas generating agent. The glazing can include, for example, graphite. The content of the glazing in the gas generating composition is preferably 0.01 to 0.2% by weight, particularly preferably 0.05 to 0.1% by weight.

Further, the gas generating composition of the present invention can be blended with a curing agent. The curing agent can include, for example, hexamethylene diisocyanate (HMDI), 2,4-toluene diisocyanate (TDI), dimer diisocyanate (DDI) and isophorone diisocyanate (IPDI) as well as a mixture thereof. The content of the curing agent in the gas generating composition is preferably 0.1 to 5% by weight, particularly preferably 1 to 3% by weight.

Further, the gas generating composition of the present invention can be blended with a bonding agent. The bonding agent can include, for example, 1,2-tris(2-methylaziridenyl) phosphine oxide (trade name: MAPO) etc. The content of the bonding agent in the gas generating composition is preferably 0.1 to 1% by weight, particularly preferably 0.1 to 0.5% by weight.

Further, the gas generating composition of the present invention can be blended with a crosslinking agent. The crosslinking agent can include, for example, ammoniumbenzoate, trimethylol propane (TMP) and a mixture thereof. The content of the crosslinking agent in the gas generating composition is preferably 0.1 to 3% by weight, particularly preferably 0.1 to 1% by weight.

Further, the gas generating composition of the present invention can be blended with a metal fuel. The metal fuel can include, for example, aluminum, magnesium and a mixture thereof. The content of the metal fuel in the gas generating composition is preferably 0.5 to 25% by weight, particularly preferably 1 to 20% by weight.

Further, the gas generating composition of the present invention can be blended with a combustion catalyst. The combustion catalyst can include, for example, iron oxide, copper oxide, copper chromite and ammonium dichromate as well as a mixture thereof. The content of the combustion catalyst in the gas generating composition is preferably 0.1 to 10% by weight, particularly preferably 0.2 to 5% by weight.

Further, the gas generating composition of the present invention can be blended with an aging inhibitor. The aging inhibitor can include, for example, phenylisopropyl-P-phenylene diamine (trade name: NOCRAC 810-NA) and the like. The content of the aging inhibitor in the gas generating composition is preferably 0.1 to 3% by weight, particularly preferably 0.1 to 0.5% by weight.

The gas generating composition of the present invention can be produced in any conventional methods with no particular restriction. For example, it can be prepared by mixing required components among the binder, nitrogen-containing compound, oxidizing agent, chlorine-neutralizing agent, ignition improver, stabilizer, flash reducing agent, plasticizer, deterrent, glazing, curing agent, bonding agent, crosslinking agent, metal fuel, combustion catalyst and aging inhibitor in the presence of organic solvent or water and then making the same into powder or extruded pellets.

The gas generating composition of the present invention can be molded into a desired shape for use. For example, it can be molded into pellets or extrusion-molded into extruded pellets by an extruder (extrusion-molding machine). Further, the extruded pellets may have either a non-perforated shape or a pored shape. In the case of the pored shape, it may be a single-perforated shape with only one pore, or a perforated (porous) shape having a plurality of pores (e.g. 2 to 7 pores).

The size of the extruded pellets is an outer diameter of 0.6 to 5.0 mm, preferably 0.8 to 4.0 mm, an inner diameter of 0.05 to 3.0 mm, preferably 0.1 to 1.0 mm and a length of 0.5 to 10.0 mm, preferably 0.8 to 5.0 mm.

The gas generating composition according to the present invention can be disposed in a pretensioner device and used by burning the composition in conventional way.

The gas generating composition according to the present invention is particularly useful as a gas generating agent for use in a pretensioner of a seat belt device which is mounted on automobiles and aircrafts, etc. for protecting human bodies.

EXAMPLES

Hereinafter, the present invention is described in more detail with reference to the Examples and Comparative Examples, but the invention is not limited to such examples.

Examples 1 to 17 and Comparative Example 1

Table 1 shows a result of calculation for theoretical combustion of gas generating compositions. Combustion temperature, total amount of generated gases, and amount and concentration of generated CO of various gas generating compositions are shown in the Examples, and combustion temperature, total amount of generated gases, and amount and concentration of generated CO of a nitrocellulose gas generating composition are shown in the Comparative Example.

The CO concentration for the gas generating compositions in the Examples is greatly reduced than the CO concentration for the nitrocellulose gas generating composition in the Comparative Example.

Example 18 and Comparative Example 2

Theoretical calculation for the gas generating composition with the formulation shown in Table 2 was conducted to examine the concentration of hydrogen chloride in generated gases. The concentration of hydrogen chloride in the composition not containing the chlorine-neutralizing agent was also examined as the comparative example.

It was found that the concentration of hydrogen chloride in generated gases from the gas generating composition of the present invention is lower than the concentration of hydrogen chloride in the composition not containing the chlorine-neutralizing agent.

Comparative Example 3

Nitrocellulose containing 25% by weight of ethanol, and diphenylamine, were weighed to provide a composition (nitrocellulose/diphenylamine=100 parts by weight/1 part by weight) after drying. The mixture was introduced into a kneader, and further 25 parts by weight of acetone was added thereto, and the mixture was mixed and kneaded for about 2 hours. Then, the kneaded mixture was extruded through a die with an outer diameter of 1.8 mmϕ and an inner diameter of 0.3 mmϕ under a pressurizing condition at a pressure of 100 kgf/cm$^2$ to prepare a single pore cylindrical string-shaped product. Further, this string-shaped product was cut by a cutting machine into pieces of 1.4 mm in length.

The molded article of the gas generating agent containing the solvent was placed in a dryer controlled at 30° C., preliminarily dried for 16 hours, and then placed in a dryer controlled at a temperature of 50° C. and dried for 30 hours.

Then, the molded article of the gas generating agent and graphite were introduced into a blender to deposit 0.05 part by weight of graphite thereon. Finally, it was sieved in a sieving machine, and excess graphite and dusts of the gas generating agent were removed to give a molded article of the gas generating agent.

Example 19

Materials (cellulose acetate butyrate/ethyl phthalyl ethyl glycolate) were weighed to give a composition (12 parts by weight/4 parts by weight) The mixture was introduced into a kneader, and a mixed solvent (acetone/ethyl acetate=4 parts by weight/8 parts by weight) was added thereto, and the mixture was mixed and kneaded for about 10 minutes. Then, 84 parts by weight of ammonium perchlorate with an average particle diameter of 5 $\mu$m were added thereto, and the mixture was mixed and kneaded for about 1 hour. Then, the kneaded mixture was extruded through a die with an outer diameter of 1.8 mmϕ under a pressurizing condition at a pressure of 100 kgf/cm$^2$ to prepare a string-shaped product. Further, this string-shaped product was cut by a cutting machine into pieces of 1.0 mm in length.

The molded article of the gas generating agent containing the solvent was placed in a dryer controlled at 30° C., preliminarily dried for 16 hours, and then placed in a dryer controlled at a temperature of 50° C. and dried for 16 hours.

Then, the molded article of the gas generating agent and graphite were introduced into a blender to deposit 0.05 part by weight of graphite thereon. Finally, it was sieved in a sieving machine, and excess graphite and dusts of the gas generating agent were removed to give a molded article of the gas generating agent.

Example 20

A molded article of the gas generating agent (cellulose acetate/cellulose acetate butyrate/ammonium perchlorate/ethyl phthalyl ethyl glycolate/sodium nitrate=9 parts by weight/9 parts by weight/46.8 parts by weight/4 parts by weight/31.2 parts by weight) was obtained in the same manner as in Example 19.

Example 21

A molded article of the gas generating agent (cellulose acetate/ammonium perchlorate/ethyl phthalyl ethyl glycolate/sodium nitrate=18 parts by weight/46.8 parts by weight/4 parts by weight/31.2 parts by weight) was obtained in the same manner as in Example 19.

Examples 22 to 24 and Comparative Example 4

17 g of the molded article of the gas generating agent obtained in each example (Examples 19 to 21 and Comparative Example 3) was burnt in a closed bomb at room temperature. A bomb having an inner volume of 170 cc was used. After the burning, gases were taken into a gas sampling bag and measured for CO concentration by a detection tube. The results are shown in Table 3. The concentration of CO from the gas generating compositions of the present invention was found to be considerably lower than the CO concentration from the composition in the Comparative Example.

Examples 25 to 26 and Comparative Example 5

The thermal analysis (DTA) of the following gas generating compositions obtained in the same manner as in Example 19 was conducted. The results are shown in Table 4.

The DTA exothermic peak temperatures of the gas generating compositions of the present invention were found to be higher than that of the nitrocellulose-containing composition in Comparative Example 4. The compositions of the present invention were found to have higher thermal stability.

TABLE 1

| | Composition (wt %) | Combustion temperature (k) | Total amount of generated gas (mol/100 g) | CO amount (mol/100 g) | CO concentration (%) |
|---|---|---|---|---|---|
| Comparative Example 1 | Nitrocellulose (100) | 2686 | 3.8299 | 0.94891 | 24.8 |
| Example 1 | Starch/$NH_4ClO_4$ (22.3/77.7) | 2957 | 3.4977 | 0 | 0.0 |
| Example 2 | Starch/$NH_4ClO_4$/$NaNO_3$ (25.0/43.5/31.5) | 2663 | 2.8429 | 0.00000453 | 0.0 |
| Example 3 | Silicone/$NH_4ClO_4$ (16.4/83.6) | 3191 | 3.2449 | 0.00000361 | 0.0 |
| Example 4 | Silicone/$NH_4ClO_4$/$NaNO_3$ (18.6/47.2/34.2) | 2925 | 2.6797 | 0.000024 | 0.0 |
| Example 5 | Polystyrene/$NH_4ClO_4$ (10/90) | 3197 | 3.4500 | 0.00225 | 0.0 |
| Example 6 | Polystyrene/$NH_4ClO_4$/$NaNO_3$ (11.3/51.4/37.2) | 2920 | 2.7772 | 0.0000151 | 0.0 |
| Example 7 | Polybutadiene/$NH_4ClO_4$ (9.5/90.5) | 3189 | 3.5400 | 0.00233 | 0.0 |
| Example 8 | Polybutadiene/$NH_4ClO_4$/$NaNO_3$ (10.8/51.7/37.5) | 2910 | 2.8652 | 0.00002 | 0.0 |
| Example 9 | Polyacrylonitrile/$NH_4ClO_4$ (13.1/86.9) | 3151 | 3.4530 | 0.000931 | 0.0 |
| Example 10 | Polyacrylonitrile/$NH_4ClO_4$/$NaNO_3$ (15.0/49.3/35.7) | 2878 | 2.7793 | 0.01206 | 0.4 |
| Example 11 | Polyvinyl chloride/$NH_4ClO_4$ (21/79) | 3197 | 3.3612 | 0.00000160 | 0.0 |
| Example 12 | Polyvinyl chloride/$NH_4ClO_4$/$NaNO_3$ (23.6/44.3/32.1) | 2984 | 2.6517 | 0.000547 | 0.0 |
| Example 13 | Cellulose acetate butyrate/ RDX/$KClO_4$ (10/44/46) | 3352 | 2.7520 | 0.0673 | 2.4 |
| Example 14 | Cellulose acetate butyrate/ RDX/$KNO_3$ (10/39/51) | 2626 | 2.3571 | 0.0611 | 2.6 |
| Example 15 | Cellulose acetate butyrate/ Nitroguanidine/$KClO_4$ (10/39/51) | 2920 | 2.6549 | 0.00969 | 0.4 |
| Example 16 | Cellulose/$KClO_4$ (28/72) | 2929 | 2.1883 | 0.0000531 | 0.0 |
| Example 17 | Cellulose/$NH_4ClO_4$/$KNO_3$ (23.5/41.1/35.4) | 2679 | 2.6944 | 0.00000121 | 0.0 |

TABLE 2

| | Composition (wt %) | Concentration of hydrogen chloride (%) |
|---|---|---|
| Comparative Example 2 | Starch/$NH_4ClO_4$ (22.3/77.7) | 18.9 |
| Example 18 | Starch/$NH_4ClO_4$/$NaNO_3$ (25.0/43.5/31.5) | 0.010 |

TABLE 3

| NO. | Comparative Example 4 | Example 22 | Example 23 | Example 24 |
|---|---|---|---|---|
| Nitrocellulose | 100 | | | |
| Diphenylamine | 1 | | | |
| Graphite | 0.05 | 0.05 | 0.05 | 0.05 |
| Cellulose acetate butyrate | | 12 | 9 | |
| Cellulose acetate | | | 9 | 18 |
| Ethyl phthalyl ethyl glycolate | | 4 | 4 | 4 |
| Ammonium perchlorate | | 84 | 46.8 | 46.8 |
| Sodium nitrate | | | 31.2 | 31.2 |
| CO concentration (%) | 43 | 3 | 5 | 4 |

TABLE 4

| NO. | Comparative Example 5 | Example 25 | Example 26 |
|---|---|---|---|
| Nitrocellulose | 100 | | |
| Diphenylamine | 1 | | |
| Graphite | 0.05 | 0.05 | 0.05 |
| Cellulose acetate butyrate | | 12 | 16 |
| Methyl phthalyl ethyl glycolate | | | 4 |
| Ethyl phthalyl ethyl glycolate | | 4 | |
| Ammonium perchlorate | | 84 | |
| Potassium perchlorate | | | 80 |
| DTA exothermic peak temperature (° C.) | 200.8 | 244.4 | 359.5 |
| Remarks | Decomposition was initiated at about 170° C. or more. | Decomposition was initiated at about 220° C. or more. | Decomposition was initiated at about 320° C. or more. |

What is claimed is:

1. A gas generating composition for use in a pretensioner, which comprises 70 to 93 weight-% of an oxidizing agent, 7 to 30 weight-% of a binder comprising at least one compound selected from the group consisting of cellulose acetate butyrate (CAB), carboxymethyl cellulose sodium (CMC-Na), hydroxyethyl cellulose (HEC), hydroxypropyl cellulose (HPC), methyl cellulose (MC), ethyl hydroxyethyl cellulose (EHEC), carboxymethyl ethyl cellulose (CMEC), starch, guar gum, polyvinyl alcohol (PVA), polyacrylamide, acrylic rubber, polystyrene (PS), polyacrylonitrile (PAN), polyvinyl chloride (PVC), hydroxy-terminated polybutadiene (HTPB), and carboxy-terminated polybutadiene (CTPB), 0.1 to 10 weight-% of a plasticizer, and 0.05 to 0.1 weight-% of a gloss.

2. The gas generating composition for use in a pretensioner according to claim 1, wherein the oxidizing agent is an ammonium salt, an alkali metal salt or an alkaline earth metal salt of chloric acid, perchloric acid, nitric acid or nitrous acid.

3. The gas generating composition for use in a pretensioner according to claim 1, wherein the oxidizing agent is one or more compounds selected from the group consisting of ammonium perchlorate, potassium perchlorate, sodium perchlorate, potassium nitrate, sodium nitrate and strontium nitrate.

4. A gas generating composition for use in a pretensioner, which comprises 7 to 30 weight-% of a binder comprising at least one compound selected from the group consisting of cellulose acetate (CA), cellulose acetate butyrate (CAB), coroxymethyl cellulose sodium (CMC-Na), hydroxyethyl cellulose (HEC), hydroxypropyl cellulose (HPC), methyl cellulose (MC), ethyl cellulose (EC), ethyl hydroxyethyl celluose (EHEC), carboxymethyl ethyl cellulose (CMEC), starch, guar gum, polyvinyl alcohol (PVA), polyacrylamide, acrylic rubber, polystyrene (PS), polybutadiene (PB), polyacrylonitrile (PAN), polyvinyl chloride (PVC), polyurethane, hydroxy-terminated polybutadiene (HTPB), and carboxy-terminated polybutadiene, 70 to 93 weight-% of an oxidizing agent, 5 to 50 weight-% of a chlorine-neutralizing agent), 0.1 to 10 weight-% of a plasticizer, and 0.05 to 0.1 weight-% of a gloss.

5. The gas generating composition for use in a pretensioner according to claim 4, wherein the chlorine-neutralizing agent is a compound comprising cations selected from alkali metals and alkaline earth metals.

6. The gas generating composition for use in a pretensioner according to claim 4, wherein the oxidizing agent is an ammonium salt, an alkali metal salt or an alkaline earth metal salt of chloric acid, perchloric acid, nitric acid or nitrous acid.

7. The gas generating composition for use in a pretensioner according to claim 6, wherein the oxidizing agent is one or more compounds selected from the group consisting of ammonium perchlorate, potassium perchlorate, sodium perchlorate, potassium nitrate, sodium nitrate and strontium nitrate.

8. The gas generating composition for use in a pretensioner according to claim 1 or claim 4, which further comprises 5 to 50% by weight of a nitrogen-containing compound.

9. The gas generating composition for use in a pretensioner according to claim 8, wherein the nitrogen-containing compound is guanidine derivative, tetrazole derivative, bitetrazole derivative, triazole derivative, hydrazine derivative, triazine derivative, azodicarbonamide derivative, dicyanamide derivative or nitramine derivative.

10. The gas generating composition for use in a pretensioner according to one of claim 1 or 4, which comprises 1 to 10% by weight of nitrocellulose (NC), cellulose acetate nitrate (CAN) or cellulose nitrate carboxymethyl ether (CNC) as an ignition improver.

11. A pretensioner system using the gas generating composition described in claim 1 or in claim 4.

12. The gas generating composition of claim 10, comprising ammonium perchlorate oxidizing agent, hydroxypropylcellulose binder, sodium nitrate chlorine-neutralizing agent, nitroguanidine nitrogen-containing compound, and nitrocellulose ignition improver.

13. The gas generating composition of claim 1, comprising starch and ammonium perchlorate.

14. The gas generating composition of claim 4, comprising starch, ammonium perchlorate, and sodium nitrate.

15. The gas generating composition of claim 8, comprising cellulose acetate butyrate, trimethylene trinitramine, and potassium perchlorate.

16. The gas generating composition of claim 1 or claim 4, wherein the plasticizer is ethyl phthalyl ethyl glycolate and the gloss is a glazing of graphite.

17. The gas generating composition of claim 1, comprising 70 to 93 weight-% of said oxidizing agent and 7 to 30 weight-% of said binder.

18. The gas generating composition of claim 4, comprising 70 to 93 weight-% of said oxidizing agent and 7 to 30 weight-% of said binder.

* * * * *